US007464831B2

(12) United States Patent
Aiken

(10) Patent No.: US 7,464,831 B2
(45) Date of Patent: Dec. 16, 2008

(54) CONTAINER WITH COLLAPSIBLE LID

(75) Inventor: Cynthia R. Aiken, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 310 days.

(21) Appl. No.: 10/771,634

(22) Filed: Feb. 3, 2004

(65) Prior Publication Data

US 2004/0155048 A1 Aug. 12, 2004

(51) Int. Cl.
*B65D 25/00* (2006.01)
*B65D 21/00* (2006.01)

(52) U.S. Cl. ..... 220/801; 220/669; 206/508; 206/515

(58) Field of Classification Search ..... 220/801, 220/805, 287, 281, 233, 669, 660, 380, DIG. 13; 206/508, 505, 503, 515; 215/355, 231
See application file for complete search history.

(56) References Cited

U.S. PATENT DOCUMENTS 2,756,793 A * 7/1956 Tupper ..... 220/281
3,411,659 A * 11/1968 Seifert ..... 220/287
3,425,471 A * 2/1969 Yates, Jr. ..... 220/256.1
3,829,926 A * 8/1974 Salladay ..... 15/257.06
3,954,178 A * 5/1976 Mason, Jr. ..... 206/508
4,177,933 A * 12/1979 Lumpp ..... 220/801
4,256,240 A * 3/1981 Woinarski ..... 220/782
4,287,996 A * 9/1981 Wanderer ..... 217/108
4,376,493 A * 3/1983 Gall ..... 220/784
4,726,489 A * 2/1988 Padovani ..... 206/519
4,799,602 A * 1/1989 Collins et al. ..... 220/789
4,887,735 A * 12/1989 Dudzik ..... 220/789
5,402,908 A * 4/1995 Warden et al. ..... 220/554
5,839,604 A * 11/1998 Straussman ..... 220/789
6,138,899 A * 10/2000 Grabher ..... 229/5.5
6,250,494 B1 * 6/2001 Diamond ..... 220/783

FOREIGN PATENT DOCUMENTS

EP 0 286 230 A1 * 10/1988
GB 2350353 A * 11/2000
WO WO 02/098754 A1 * 12/2002

* cited by examiner

*Primary Examiner*—Robin Hylton
(74) *Attorney, Agent, or Firm*—Carlson Gaskey & Olds

(57) ABSTRACT

Provided herein is a lid arranged for receipt within a container that has a tapered wall structure and a base. The lid includes a peripheral portion and a central portion integrally attached to each other. The peripheral portion is collapsibly deformable toward the central portion as the lid is movably oriented within the container toward the base.

17 Claims, 9 Drawing Sheets

CONTAINER WITH COLLAPSIBLE LID

BACKGROUND OF THE INVENTION

1. Field of the Invention

The present invention relates generally to a container with lid.

2. Background Art

Many containers do not have lids. Many that do have lids are limited in use. For example, some lids are limited by their placement, which is generally around the periphery of rim of the upper opening of the container. Should the container have produce or fragile goods inside, the produce or goods may subject to bruising or damage during shipment as a result of having more space in which to move within the container. Moreover, since the containers are also not efficient in terms of space during storage or shipment. For example, a container with a lid as described above may stack on a similar container having a lid, but will stack at a pre-determined height, no matter what or how many contents are in the container.

Consequently, a container is desired which will limit the movement of the contents of the container, as well as provide more efficient stacking of the container related to the amount of goods stored in the container.

SUMMARY OF THE INVENTION

Accordingly, it is an object according to the present invention to provide a container and lid which will limit the movement of the goods stored therein.

It is another object according to the present invention to provide a container and lid that are capable of being stored and transported more efficiently and economically.

It is also another object according to the present invention to provide a container and lid which are capable of being stacked efficiently relative to the quantity of the contents in the container.

In carrying out the above objects and other objects, the present invention provides a container and lid assembly having a base, a container body having a generally tapered wall structure extending upwardly from the base defining a compartment therein, and a lid having a flexible peripheral portion that is collapsibly deformable as the lid is moved along a predetermined range within the compartment.

Further provided herein is a lid arranged for receipt within a container that has a tapered wall structure and a base. The lid includes a peripheral portion and a central portion integrally attached to each other. The peripheral portion is collapsibly deformable toward the central portion as the lid is movably oriented within the container toward the base. The peripheral portion is expandably deformable as the lid is returned toward the container opening.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
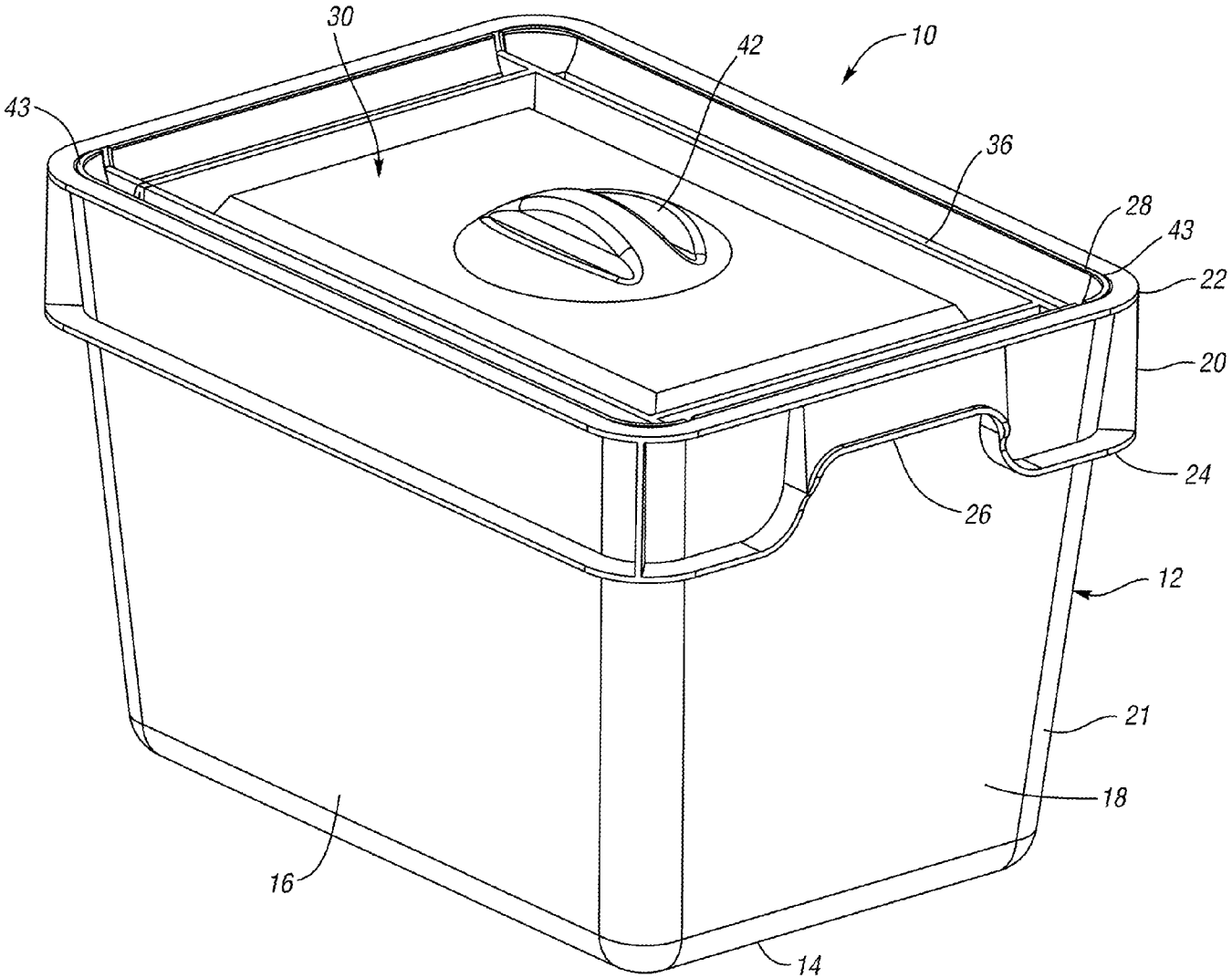
FIG. 1 is a perspective view showing the container with lid according to the present invention.
Figure 2:
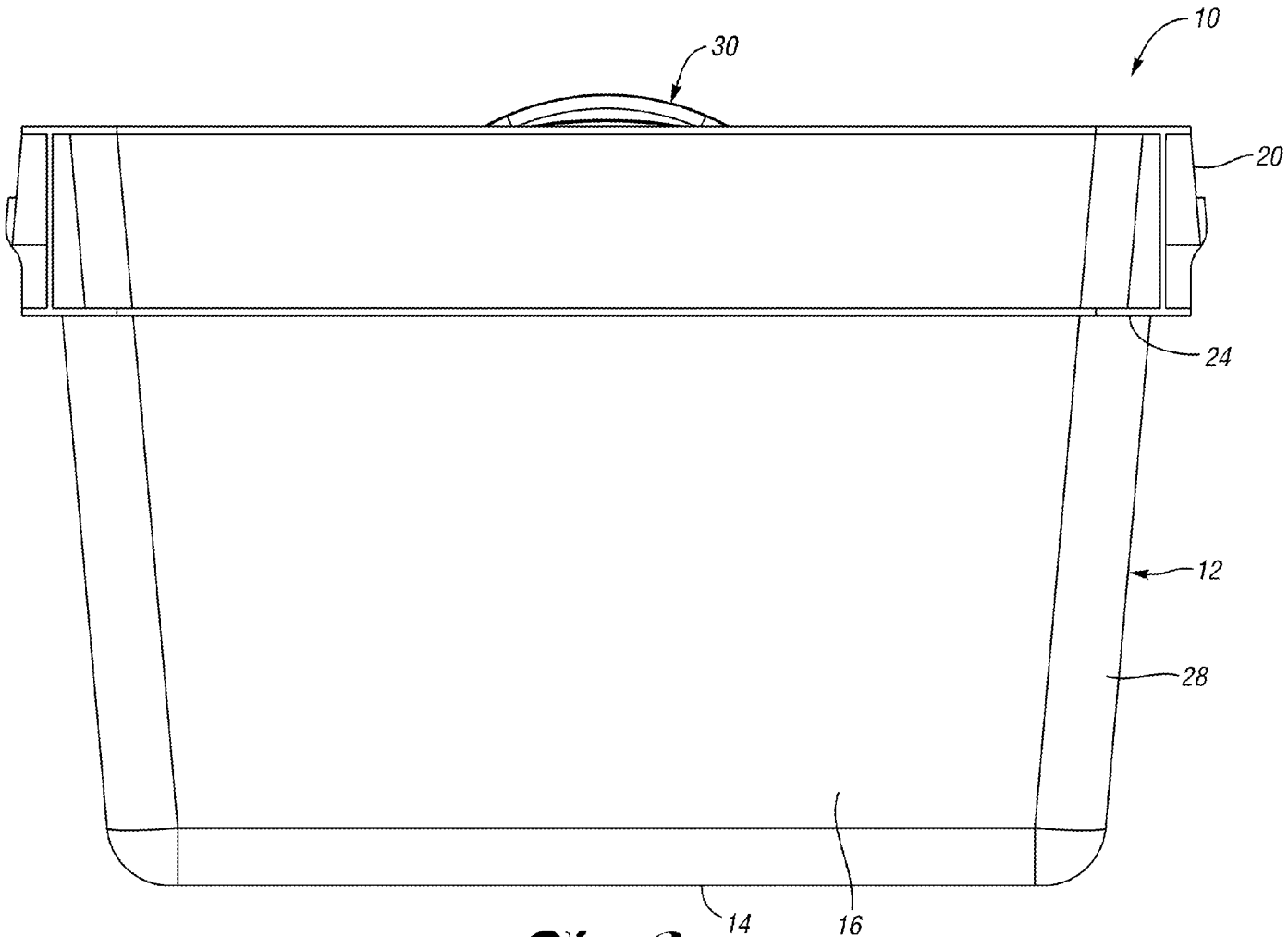
FIG. 2 is a side elevational view of the container with lid of FIG. 1, where the lid is disposed proximate the opening of the container body the other side being a mirror image thereof.
Figure 3:
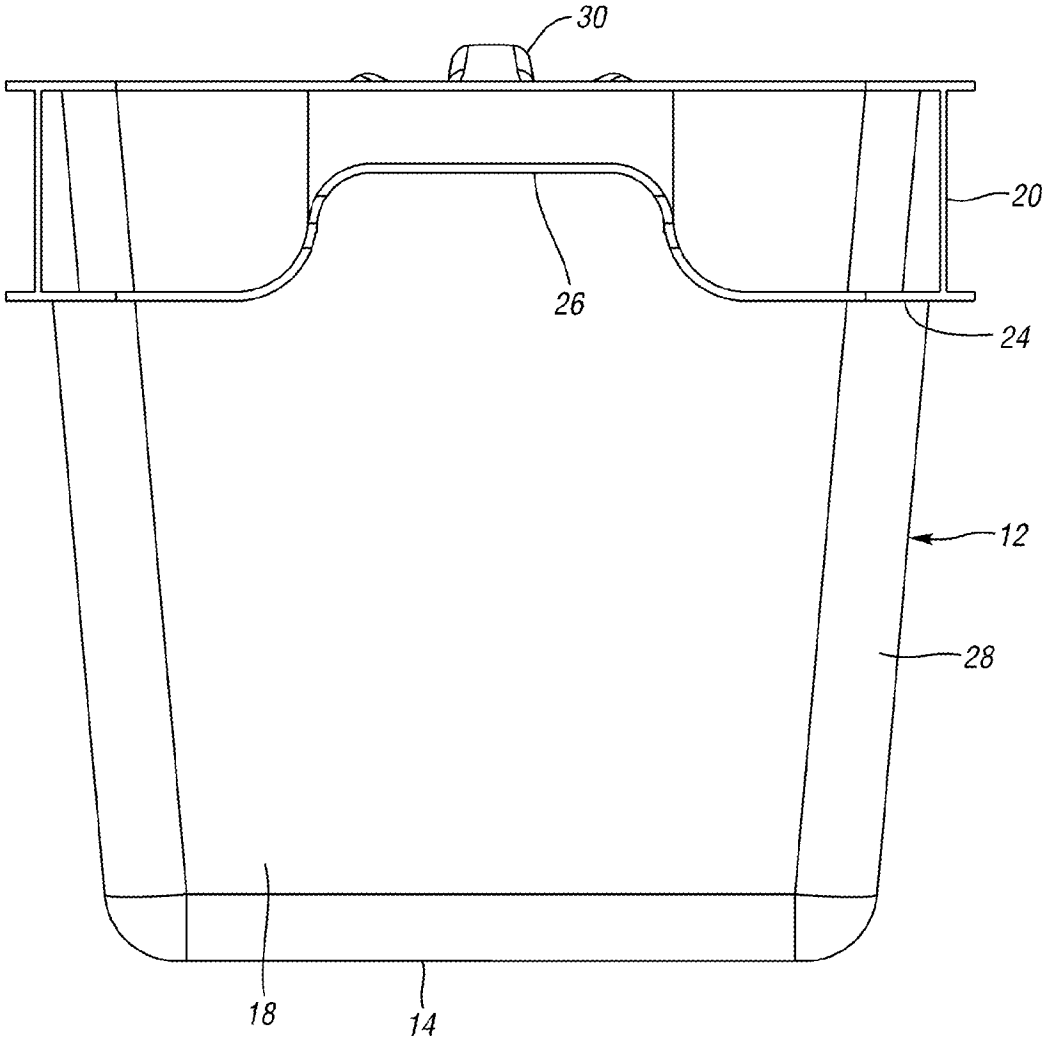
FIG. 3 is an end elevational view of the container with lid of FIG. 1, where the lid is disposed proximate the opening of the container body, the other side being a mirror image thereof.

With reference to FIGS. 1-9, a container with lid assembly 10 according to the present invention is shown. Container with lid assembly 10 includes a container body 12 and a lid 30. Container 12 has a base 14 and a wall structure extending upwardly from the base. The wall structure is shown generally as a four sided container having a pair of opposed side walls 16, and a pair of opposed end walls 18 integrally formed with each other to define inner compartment 19. The container body 12 is shown as having generally rounded corner portions 21. The walls of container body 12 are generally tapered to provide for lid 30 movement axially in accordance with the teachings herein, in addition to allowing for like container bodies 12 to nest when lids 30 are removed. While container body 12 and lid 30 are generally shown as rectangular herein, it is contemplated that the teachings of this invention would apply equally to containers and corresponding lids of various polygonal shapes.

Container body 12 and lid 30 may be formed via an injection molding process of various plastic materials suitable for the application, including polypropylene and high density polyethylene. Of course, these components may be formed by any suitable process and material known in the art that would provide the desired characteristics of such components.

Container 12 also includes a rim extending around the periphery of the upper portion of the container body 12. Rim 20 includes an upper edge 22 and a lower edge 24. Along end walls 18, rim 20 also includes an area 26 recessed in the lower edge 24 of rim 20 to define a handle portion whereby the container maybe grasped and handled. Rim 20 also defines the opening 28 to the container compartment 19.

Figure 4:
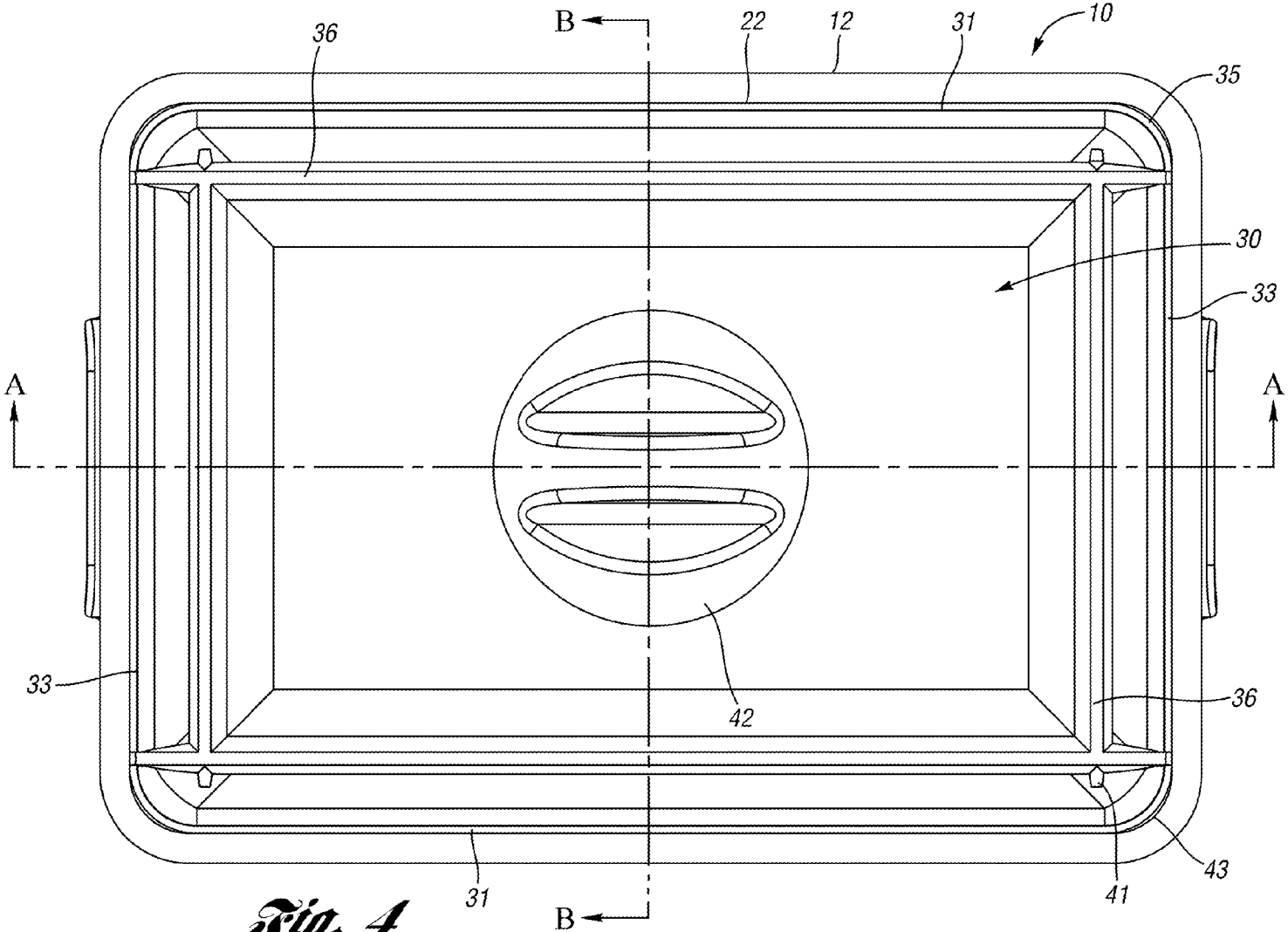
FIG. 4 is a top plan view of the container of FIG. 1.
Figure 5:
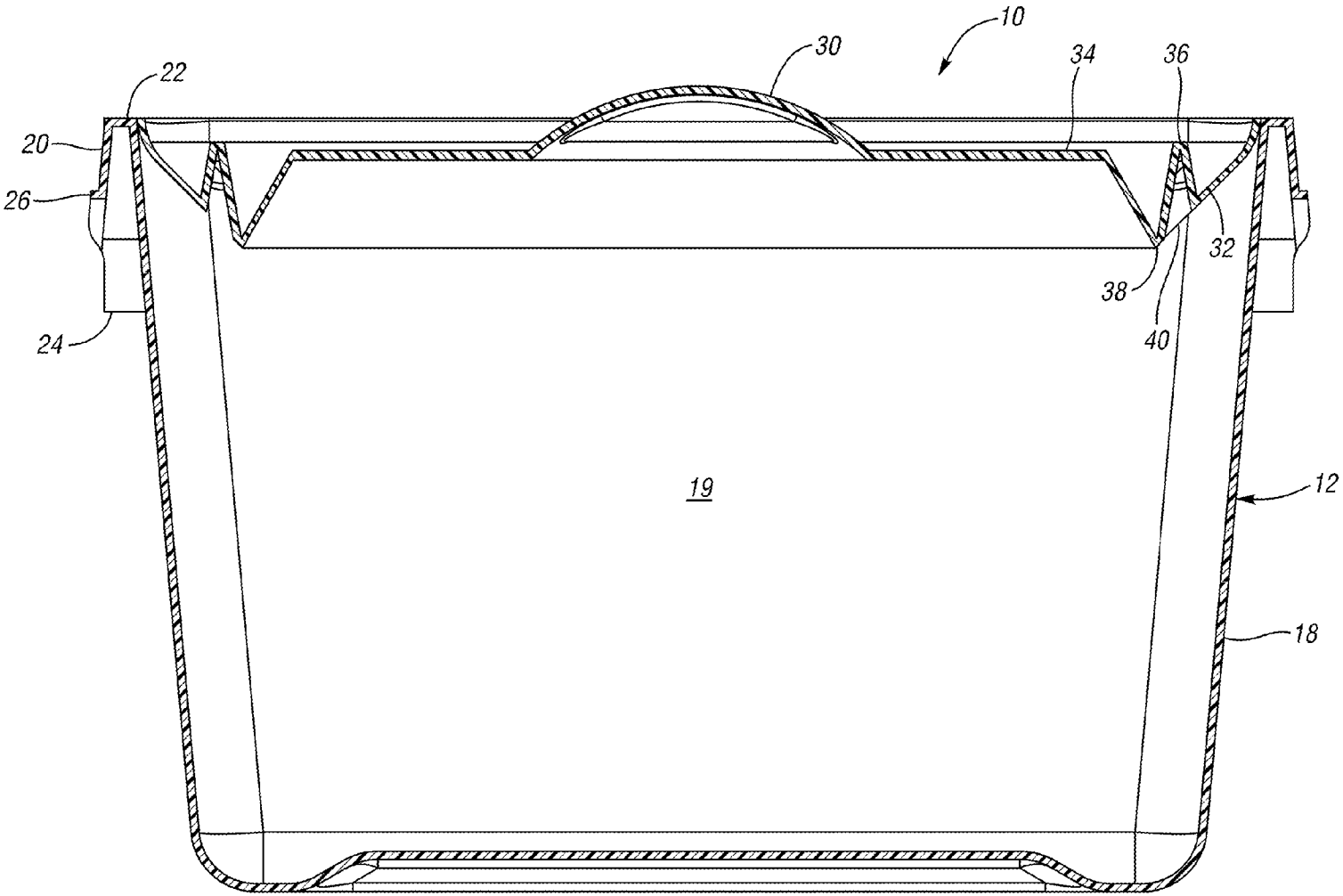
FIG. 5 is a cross-sectional view taken along the line A-A of FIG. 4.

In accordance with the present invention, container with lid assembly 10 also includes a separate, removable lid 30 which is oriented by container body 12 within opening 28. Lid 30 is capable of being received by container body 12 and moved within in a variety of vertical positions. Like container body 12, lid 30 has side edges 31, end edges 33, and corners 35 as shown in FIG. 4.

More particularly, as shown in the cross-sectional views of FIGS. 5-8, lid 30 includes a flexible or collapsible portion 32 and a central portion 34 integrally formed with the flexible portion 32. Central portion 34 includes a downwardly extending portion 38 proximate the flexible portion 32. Flexible portion 32 allows lid 30 to be adjustably received within the tapered body of container 12. While flexible portion 32 extends around all or a substantial portion of the periphery of lid 30, generally along the edges 31, 33, it is contemplated that it may be located on the lid 30 at any feasible location to provide the results desired according to the teachings herein.

Figure 6:
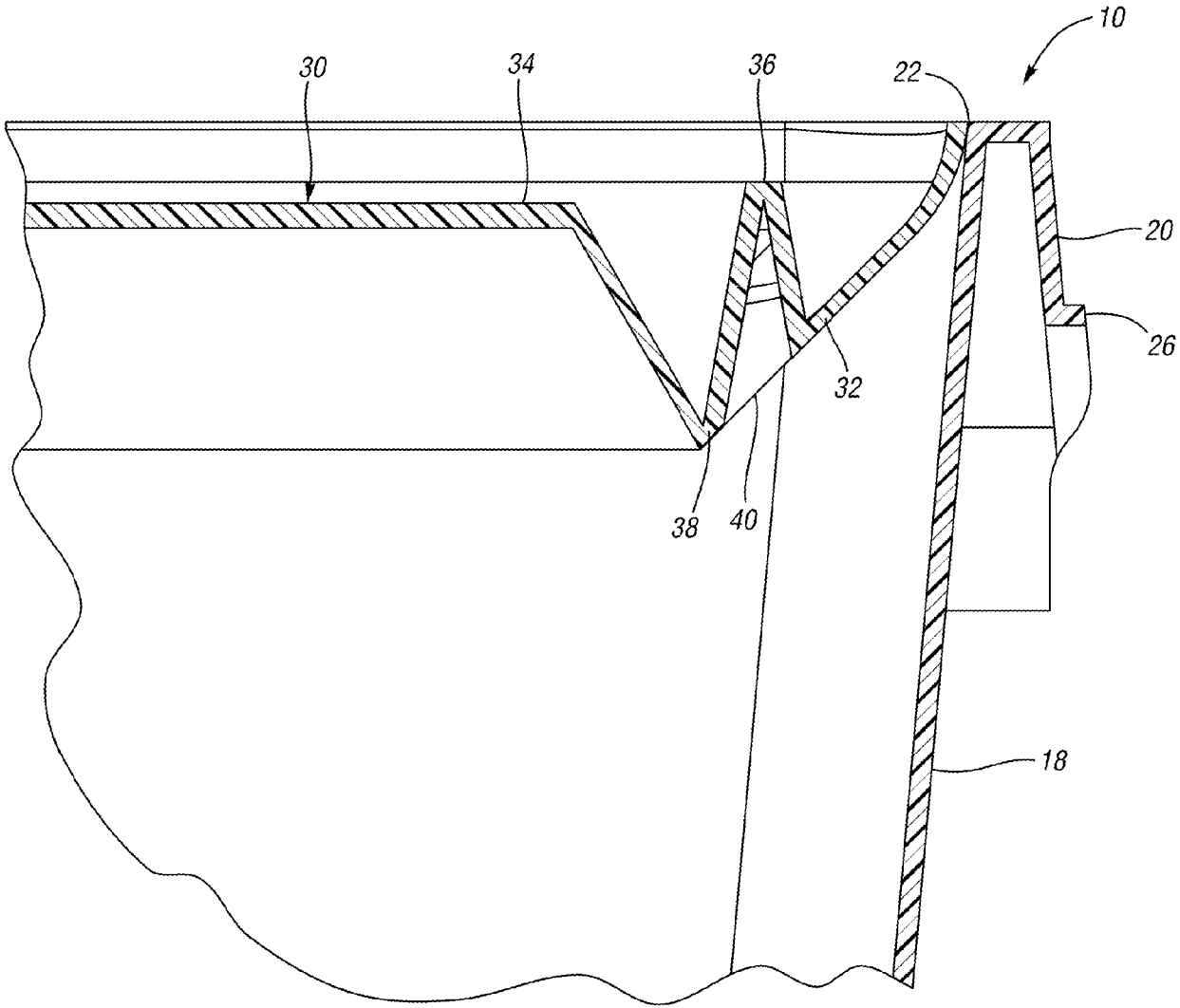
FIG. 6 is an enlarged view of a portion of FIG. 5 showing the lid and container interface.
Figure 7:
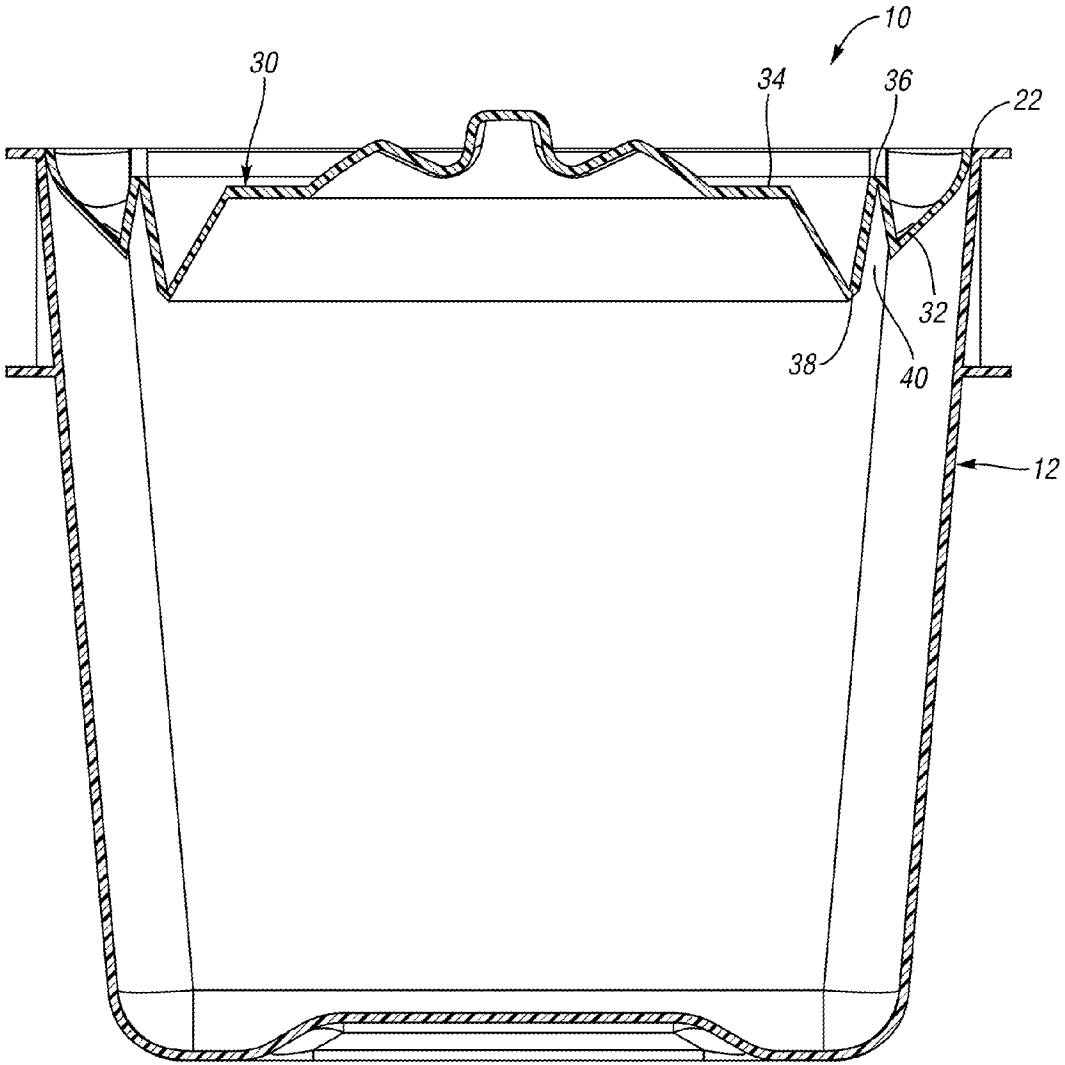
FIG. 7 is cross-sectional view taken along the line B-B of FIG. 4.
Figure 8:
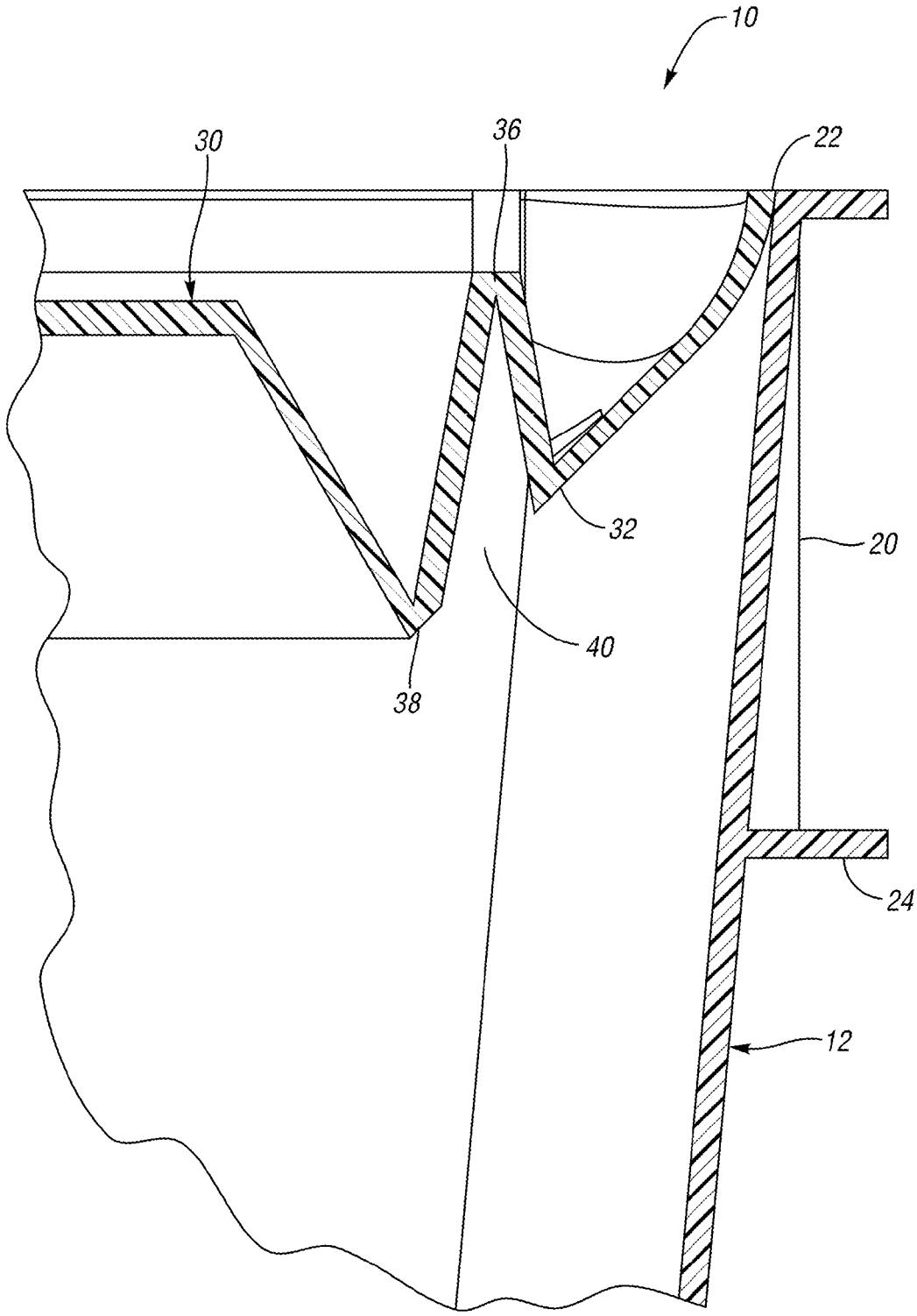
FIG. 8 is an enlarged view of a portion of FIG. 7 showing the lid and container interface.
Figure 9:
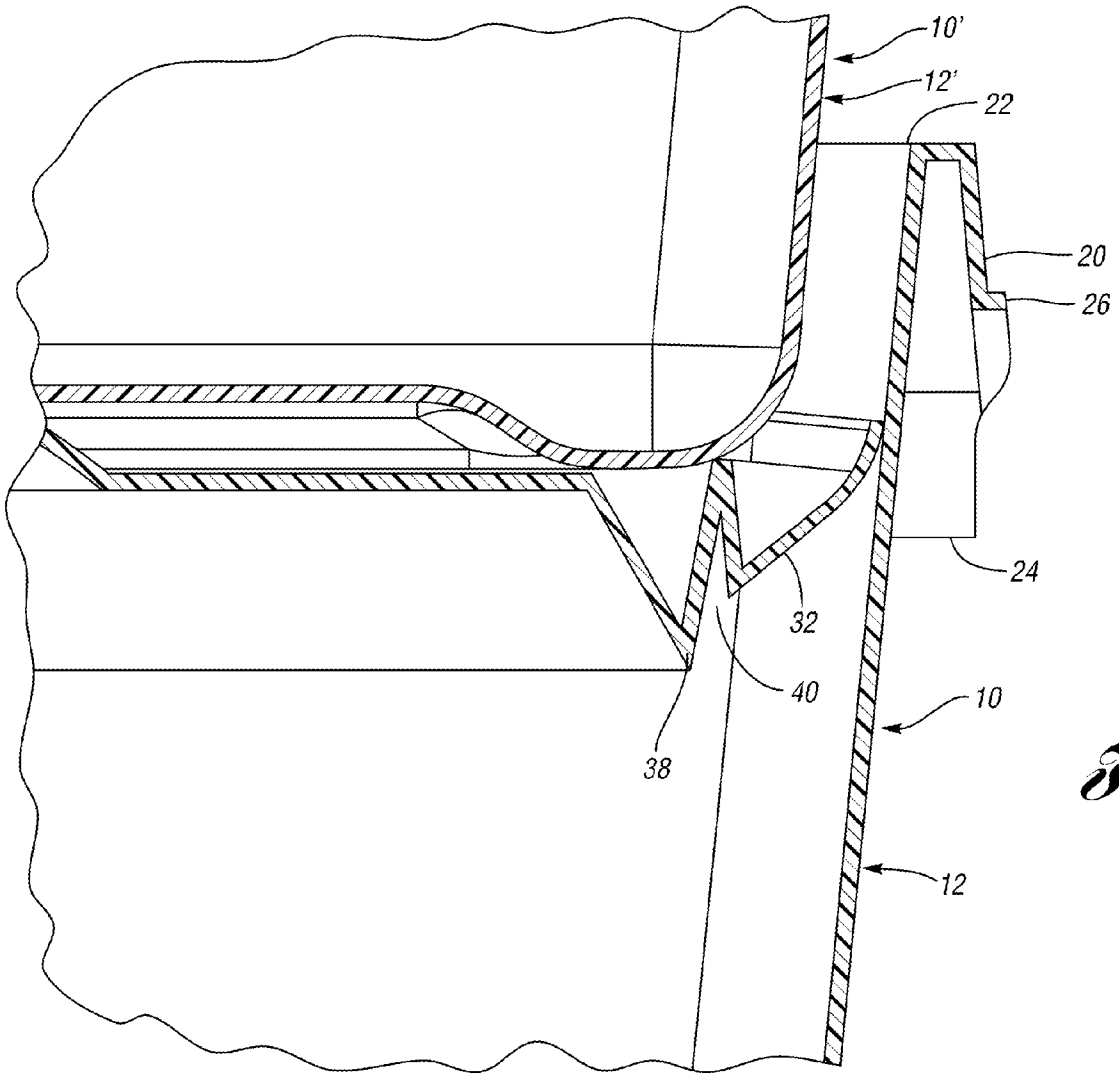
FIG. 9 is an enlarged view of a portion of FIG. 7 showing the interface between lid and container, wherein the lid is compressed and orientated relatively farther downward into the container relative to the lid position in FIGS. 1-8, the container with lid having another container stacked thereon.

With attention to FIGS. 6 and 8, flexible portion 32 is connected to the central portion 34 of lid 30 by a relatively small interface 36 disposed therebetween. Interface 36 is made of a relatively thin cross-section, resembling a living hinge. When desired by the user, the lid 30 is capable of being adjustably positioned axially within the container compartment 19, as shown in FIG. 9. As force is applied to the upper surface of the lid 30, the lid 30 is pushed downwardly into the tapered container body 12. The interference fit between container body 12 and lid 30 causes flexible portion 32 to deform and collapse in an accordion-style deflection toward downwardly extending portion 38, thus closing the gap 40 therebetween (see FIG. 9). As shown in FIG. 4, openings 41, 43 may be included in and/or adjacent lid 30 proximate the corner edges 35 for enhancing the collapsible properties of these areas. Likewise, as the lid 30 is raised upward within container body 12, flexible portion 32 is expanded away from portion 38, thereby widening the gap 40.

Thus lid 30 is able to accommodate a predetermined range of varied widths or diameters along the height of container body 12. Of course, it is contemplated that flexible portion 32 will reach a location where it will no longer be able to collapse within container body, thereby defining the predetermined lower limit for the lid. Of course, this lower limit will be dependent upon many factors, including material choice, wall thickness, size of gap 40, etc.

Lid 30 also includes a member 42 shown centrally located for acting as a handle that allows a user to grasp lid 30 in order to remove lid 30 from container body 12, or simply to move lid 30 up and down within the container body 12.

FIG. 9 illustrates container with lid assembly 10 wherein the lid 30 has its flexible portion 32 in collapsed orientation within container body 12. As shown, when the container body 12 is empty (during storage for example) or lightly filled, the lid 30 according to the present invention is able to sit lower within the container than typical lids, thereby providing for a more efficient stacking ratio when stacked with another, preferably similar container 10'.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A container and lid assembly comprising:

a base;

a container body having a generally tapered wall structure extending upwardly from the base defining a compartment therein;

a lid having a central portion and a flexible peripheral portion that is collapsibly deformable as the lid is moved along a predetermined range within the compartment toward the base, wherein the peripheral portion includes an outer portion having an upper free end abutting an inner surface of the wall structure and the central portion includes a downwardly extending portion connected to the outer portion and defining a gap between the downwardly extending portion and the outer portion.

2. The container and lid assembly of claim 1 wherein the peripheral portion at least partially circumscribes the central portion of the lid.

3. The container and lid assembly of claim 2 wherein the outer portion is moved toward the central portion as the lid is moved toward the base.

4. The container and lid assembly of claim 3 further including a hinge portion between the downwardly extending portion and the central portion.

5. The container and lid assembly of claim 4 wherein the hinge portion includes a portion of reduced thickness.

6. The container and lid assembly of claim 2 further including a handle formed in the central portion.

7. The container and lid assembly of claim 1 wherein the downwardly extending portion further includes an upper surface which would abut a base of a like container stacked thereon to urge the free end of the outer portion outwardly against the inner surface of the wall structure.

8. A container and lid assembly comprising:

a base;

a container body having a container wall extending upwardly and outwardly from the base to define a compartment therein;

a lid having a central portion and an integrally molded flexible portion, the flexible portion including an outer portion having an upper free end abutting an inner surface of the container wall, the outer portion of the flexible portion being movable toward the central portion as the lid is moved toward the base in the compartment, a hinge portion connecting the flexible portion to the central portion, the hinge portion having an upper end on which a similar container would rest when stacked thereby urging the upper free end of the outer portion against the container wall, the hinge portion above a gap between the outer portion and the central portion.

9. The container and lid assembly of claim 8 wherein the outer portion of the flexible portion is urged toward the inner surface of the container wall.

10. The container and lid assembly of claim 8 further including a like container stacked on the lid and abutting the flexible portion to urge the outer portion against the inner surface of the container wall.

11. The container and lid assembly of claim 8 wherein the central portion further includes a handle.

12. The container and lid assembly of claim 10 wherein the central portion includes a downwardly extending portion connected to the flexible portion.

13. The container and lid assembly of claim 12 wherein the flexible portion includes a hinge portion, the like container resting on the hinge portion to urge the outer portion against the inner surface of the container wall.

14. The container and lid assembly of claim 1 wherein the downwardly extending portion has an upwardly directed portion connected to the outer portion.

15. The container and lid assembly of claim 1 wherein the gap is defined between a connection between the downwardly extending portion and the outer portion.

16. The container and lid assembly of claim 15 wherein the gap is reduced as the lid is urged downwardly into the container.

17. A container and lid assembly comprising:

a generally polygonal base;

a container body having a plurality of container walls extending upwardly and outwardly from the base to define a compartment therein; and a lid having a central portion and an integrally molded flexible portion, the flexible portion including an outer portion having an upper free end abutting an inner surface of at least one of the container walls, the outer portion of the flexible portion being movable toward the central portion as the lid is moved toward the base in the compartment, a hinge portion connecting the flexible portion to the central portion, the hinge portion having an upper end on which a similar container would rest when stacked thereby urging the upper free end of the outer portion against the at least one container wall.

* * * * *